US006173774B1

(12) United States Patent
Fox

(10) Patent No.: US 6,173,774 B1
(45) Date of Patent: Jan. 16, 2001

(54) INTER-TANDEM PUMP INTAKE

(75) Inventor: Michael Joseph Fox, Claremore, OK (US)

(73) Assignee: Baker Hughes Incorporated, Houston, TX (US)

( * ) Notice: Under 35 U.S.C. 154(b), the term of this patent shall be extended for 0 days.

(21) Appl. No.: 09/121,751

(22) Filed: Jul. 23, 1998

(51) Int. Cl.[7] ..... E21B 43/18

(52) U.S. Cl. ..... 166/265; 166/105; 166/106; 166/313

(58) Field of Search ..... 166/265, 313, 166/106, 105; 210/512.2, 788, 170

(56) References Cited

U.S. PATENT DOCUMENTS

| | | | | |
|---|---|---|---|---|
| 4,296,810 | * | 10/1981 | Price | 166/265 |
| 4,548,263 | | 10/1985 | Woods | 166/105 |
| 4,738,779 | * | 4/1988 | Carroll et al. | 210/512.2 |
| 4,805,697 | | 2/1989 | Fouillout et al. | 166/265 |
| 4,913,630 | | 4/1990 | Cotherman et al. | 417/313 |
| 5,296,153 | * | 3/1994 | Peachey | 210/787 |
| 5,456,837 | * | 10/1995 | Peachey | 210/512.2 |
| 5,693,225 | * | 12/1997 | Lee | 210/512.2 |
| 5,711,374 | * | 1/1998 | Kjos | 166/265 |
| 5,730,871 | | 3/1998 | Kennedy et al. | 210/512.2 |
| 5,794,697 | * | 8/1998 | Wolflick et al. | 166/265 |
| 5,830,368 | * | 11/1998 | Peachey | 210/747 |
| 5,842,520 | * | 12/1998 | Bolin | 166/369 |
| 5,860,476 | | 1/1999 | Kjos | 166/265 |
| 5,961,841 | * | 10/1999 | Bowers | 210/739 |

FOREIGN PATENT DOCUMENTS

| | | |
|---|---|---|
| 2194572A | 3/1988 | (GB) . |
| 2333540A | 7/1999 | (GB) . |

* cited by examiner

*Primary Examiner*—Hoang Dang
(74) *Attorney, Agent, or Firm*—Felsman, Bradley, Vaden, Gunter & Dillon, L.L.P.

(57) ABSTRACT

An assembly for use in a well containing a mixture of hydrocarbons and water wherein the assembly separates hydrocarbons or relatively lighter fluids from the mixture and injects water or relatively heavier fluids into the well. The assembly includes an upper pump that pumps the relatively lighter fluids to the surface. A tandem pump is positioned below the upper pump for pumping well fluids down to a downhole separator. An oil bypass tube is provided in communication with the tandem pump for transferring the relatively lighter fluids to the upper pump, for subsequent pumping to the surface. A recycle tube is also provided that communicates with the downhole separator and the tandem pump for transferring at least a portion of the relatively heavier fluids from the downhole separator to the tandem pump, for pumping the relatively heavier fluids back to the separator.

12 Claims, 2 Drawing Sheets

INTER-TANDEM PUMP INTAKE

TECHNICAL FIELD

This invention relates to a submersible pump assembly having a downhole hydrocyclone separator (DHS). In particular, the invention relates to a submersible pump apparatus for use in a well containing a mixture of hydrocarbons wherein the submersible pump assembly pumps lighter fluids or oils to the surface and injects heavier fluids or water into the well.

BACKGROUND ART

When receiving oil from oil wells containing a mixture of hydrocarbons and water, it is desirable to separate the hydrocarbons from the water and reinject the water either above or below the producing zone. Apparatus and methods have been proposed that make it possible to separate hydrocarbons from water and to reinject the water.

U.S. Pat. No. 5,456,837 to Peachey teaches a method of downhole cyclone oil/water separation that utilizes a cyclone separator. The cyclone separator includes a separation chamber, wherein liquids of differing densities are separated. The separator has at least one mixed liquids inlet through which liquids pass into the separation chamber, a first outlet for liquids of a first density range to pass out of the separation chamber and a second outlet for liquids of a second density range to pass out of the separation chamber. Although Peachey teaches the use of multiple separators inside of a separation chamber, Peachy does not teach a method wherein liquids are separated multiple times to facilitate more complete separation.

A difficulty with using a single separator is that some formations need disposal water to contain very low concentrations of oil. Otherwise, the ability of some injection formations to accept the disposal fluid is reduced.

BRIEF SUMMARY OF INVENTION

An assembly is provided for use in a well containing a mixture of hydrocarbons and water wherein the assembly utilizes multiple separators to separate hydrocarbons from the mixture. The assembly of the invention injects heavier fluids such as water into the well and pumps lighter fluids such as hydrocarbons to the surface. The assembly includes a first pump section having a production fluid intake for receiving a mixture of oil and water from a production zone and an outlet. The assembly also includes a second pump section having an outlet and an intake that is connected to the outlet of the first pump section. A first separator is provided having an inlet connected to the outlet of the second pump section for receiving and separating the oil and water. The first separator additionally has an oil outlet for discharging oil to flow to the surface. The first separator also includes a water outlet. A second separator is provided that has an inlet connected to the water outlet for further separating oil from the water and a purer water outlet for discharging water into an injection zone. The second separator also has a less pure water outlet connected to the intake of the second pump section for passing the less pure water back through the first and second separators.

DETAILED DESCRIPTION OF INVENTION

Figure 1:
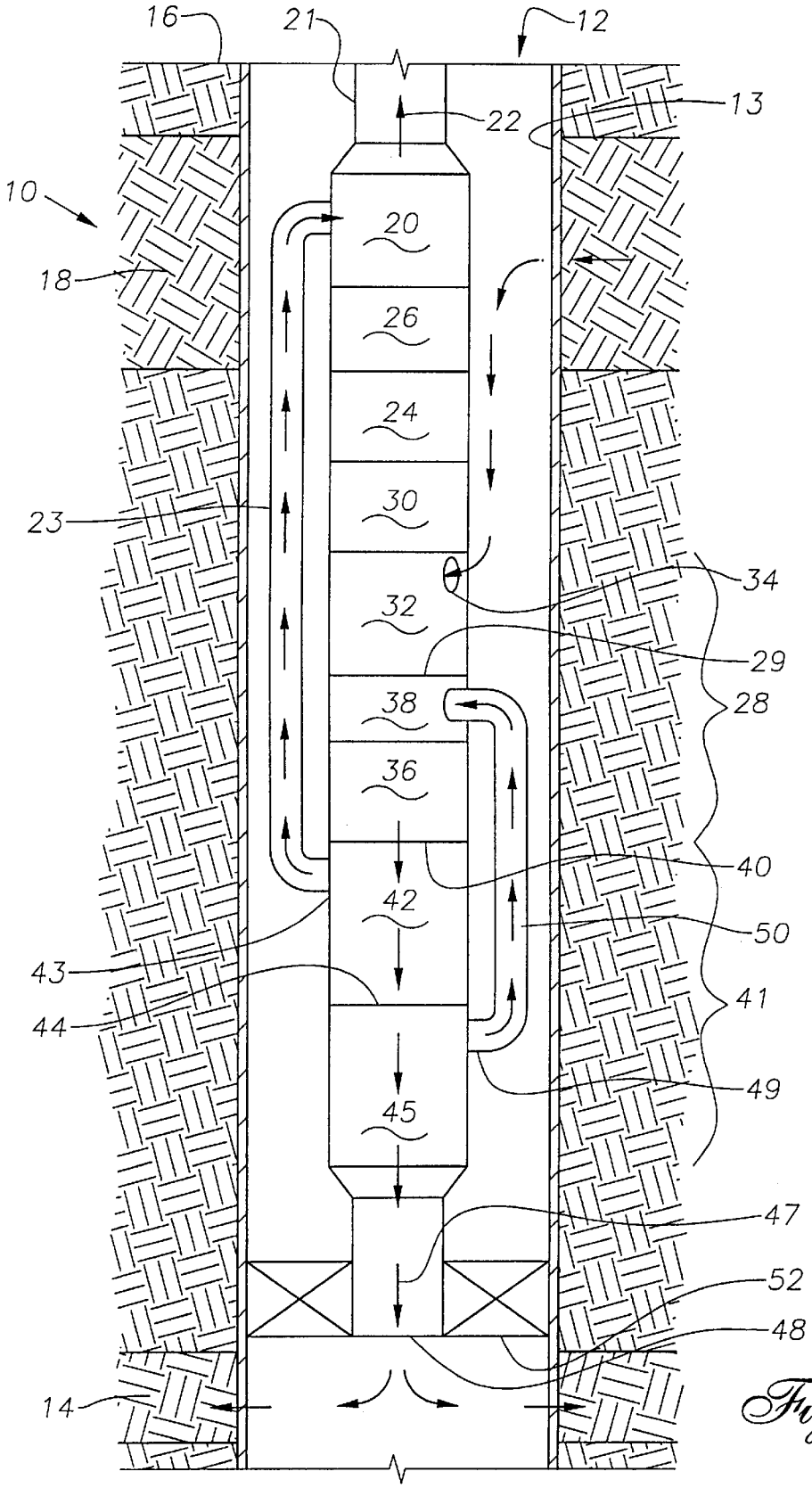
FIG. 1 is a schematic view of the assembly of the invention.
Figure 2A:
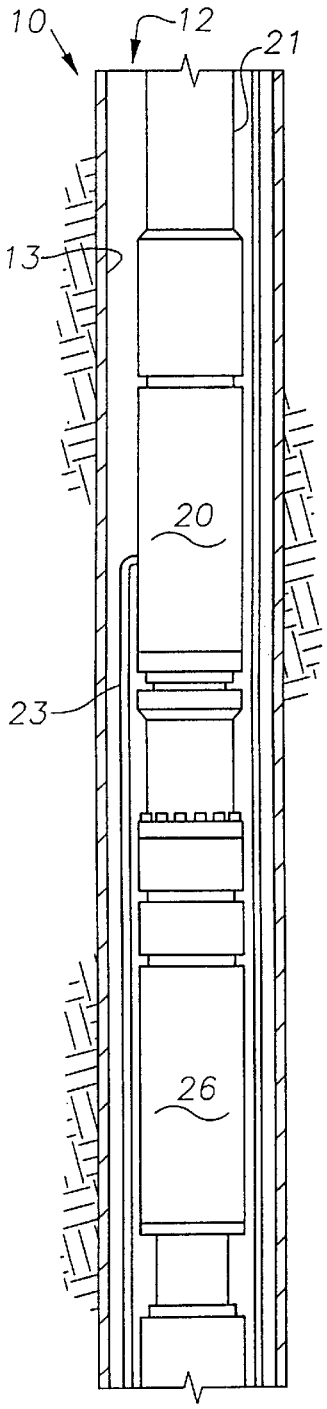
FIG. 2 is an elevation view of the assembly depicted in FIG. 1.
Figure 2B:
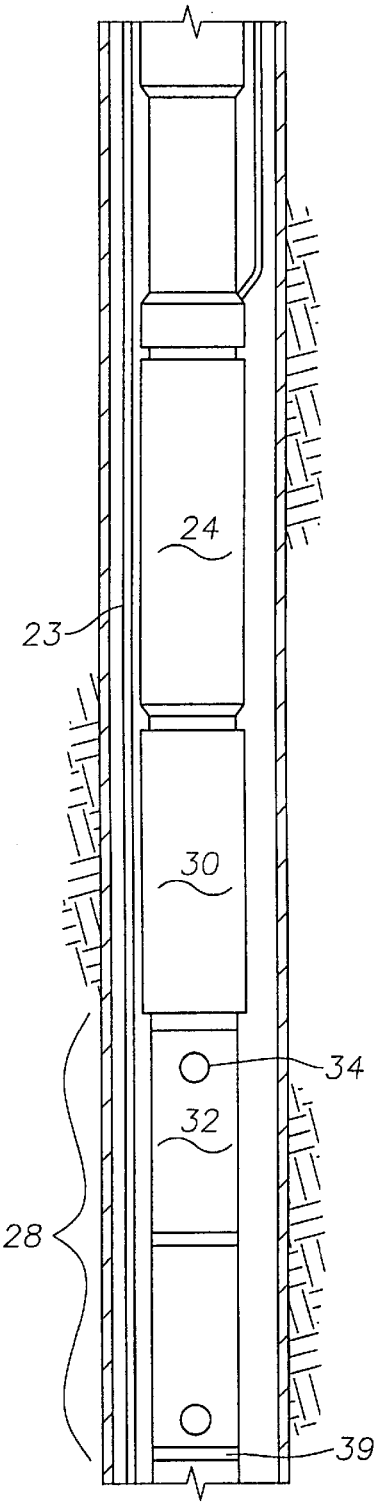
Figure 2C:
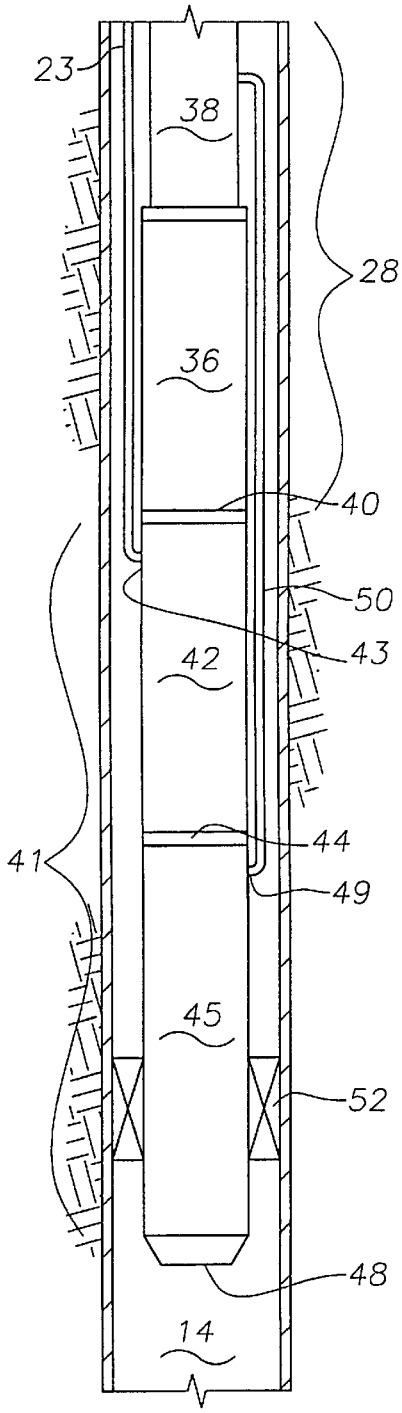

Referring to FIGS. 1 and 2, shown is an assembly designated generally 10, for use in a well 12 containing a mixture of hydrocarbons and water within well casing 13. Assembly 10 is designed to separate hydrocarbons from a mixture of well fluids in well 12. Assembly 10 injects the separated heavier fluids into an injection zone 14 of well 12 and pumps the separated lighter fluids, such as oil, to surface 16. Preferably, assembly 10 is positioned below producing zone 18. The assembly 10 includes an upper pump or third pump section 20 preferably connected to a lower end of production tubing 21 for pumping relatively lighter fluids represented by arrow 22, such as oil, to surface 16. Upper pump 20 is connected to oil bypass tube 23. The upper pump 20 is typically separated from an electrical motor 24 by a seal section 26 as is commonly known in the art.

A tandem pump or lower pump 28 is positioned below upper pump 20 and is preferably separated from motor 24 by seal section 30 which may be the same type as seal section 26. Tandem pump 28 is also a centrifical pump and is preferably constructed of first pump section or upper tandem pump section 32 having a well fluid intake or production fluid intake 34 and a second section or lower tandem pump section 36 separated from first pump section 32 by an inter-tandem intake 38. Well fluid intake 34 is on an upper end of first pump section 32. An outlet 29 of first pump section 32 is on a lower end of the first pump section 32. Outlet 40 of second pump section 36 is on a lower end of second pump section 36 and feeds downhole separator 41. Motor 24 drives upper pump 20 and first pump section 32 and second pump section 36 of tandem pump 28.

The location of inter-tandem intake 38 is determined by an amount of intake pressure required at the overflow side of the downhole hydrocyclone separator (DHS) 41.

Preferably, a first downhole separator section 42 is positioned below second pump section 36 of tandem pump 28. First downhole separator section 42 is designed to separate well fluid into relatively lighter fluids, such as oil, and relatively heavier fluids, such as water. Downhole separator 42 is preferably a vortex type referred to as a hydrocyclone. First downhole separator section 42 has an oil outlet 43 connected to oil bypass tube 23 which transfers at least a portion of the lighter oil/water to the surface via upper pump or third pump section 20 in the preferred embodiment. First downhole separator section 42 has a discharge 44 leading to a second downhole separator section 45. Although first downhole separator section 42 is quite efficient, a small percentage of oil will be present in the water discharged through discharge 44. The second downhole separator section 45 is also a hydrocyclone separator like the first downhole separator section 42 and operates in the same manner. Second downhole separator section 45 separates the water received via discharge 44 from the first downhole separator section 42 into purer water, represented by arrow 47, and injected via purer water outlet 48 into an injection zone 14 of the well 12. Second downhole separator section 45 has a less pure outlet or lighter fluid discharge 49 connected to recycle tube 50 to return fluid back to tandem pump 28 for transferring the recycled light fluids back to first downhole separator section 42 for further separation.

It is necessary for proper pressure ratios to exist between the pressure (P1) at the water discharge 44 of the first downhole separator section 42 or pressure at the inlet of the second downhole separator section 45, the pressure (P3) at the less pure outlet 49 of the second separator section 45, and the pressure (P2) at the purer water outlet 48 of the second separator section 45. The proper pressure ratios are obtained by the location of placement of inter-tandem intake 38. The proper pressure ratio is (P1–P3)/(P1–P2) equals 1.7 to 4. Preferably, the ratio is approximately 2.

Preferably, assembly 10 is positioned within well 12 and is separated from the injection zone 14 by packer 52 to prevent the purer water or separated final heavy fluid 47 from mixing with the unseparated well fluid.

In practice, assembly 10 utilizes a method of injecting water and producing oil in a well that includes separating the well fluid into relatively heavier fluid and relatively lighter fluid 22 with a downhole separator 41. The relatively lighter fluid 22 is transferred to surface 16 with upper pump or third pump section 20. At least a portion of the relatively heavier fluid is injected into injection zone 14 in well 12. At least a portion of the relatively heavier fluid is recycled through the downhole separator 41 and reseparated into purer water or separated final heavy fluid 47 for injection into injection zone 14. The unpure water from second separator section 45 is recycled by pumping the fluid through recycle tube 50 to inter-tandem intake 38 positioned between first pump section or upper tandem pump section 32 and second pump section or lower tandem pump section 36. The lighter fluid recycled through recycle tube 50 is then pumped by second pump section 36 to downhole separator 41 for additional separation.

There are several advantages to the invention. By adding a second downhole separator section, a more complete separation of hydrocarbons and water may be accomplished. Therefore, purer water may be injected back into the well. The injection of water of greater purity reduces clogging of the injection zone by the injection fluid. Feeding the lighter fluid overflow of the second separator section back to the tandem pump at an intermediate point allows the proper pressure ratios to be achieved for the second separator section.

While the invention has been shown in only one of its forms, it should be apparent to those skilled in the art that it is not so limited but is susceptible to various changes without departing from the scope of the invention.

I claim:

1. A downhole well pump assembly, comprising:

a first pump section having an outlet and a production fluid intake for receiving a mixture of oil and water from a production zone;

a second pump section having an outlet and an intake which is connected to the outlet of the first pump section;

a first separator section having an inlet connected to the outlet of the second pump section for receiving and separating the oil and water, the first separator section having a water discharge and an oil outlet for discharging oil to flow to the surface; and a second separator section having an inlet connected to the water discharge for further separating oil from the water, a purer water outlet for discharging into a desired location and a less pure water outlet connected to the intake of the second pump section downstream of the first pump section for passing the less pure water back through the first and second separator sections.

2. A downhole well pump assembly according to claim 1, further comprising:

a third pump section connected to the oil outlet of the first separator section for assisting in pumping the oil to the surface.

3. A downhole well pump assembly according to claim 1 wherein said first and said second pump sections are a located above said first and second separator sections and pump downward from the production fluid intake to the first separator section.

4. A downhole well pump assembly according to claim 1 wherein a single motor drives said first and said second pump sections.

5. A downhole well pump assembly according to claim 1 wherein the ratio $(P_1-P_3)/(P_1-P_2)$ is between approximately 1.7 and 4.0, wherein $P_1$ is defined as the pressure at the inlet to the second separator section;

$P_2$ is defined as the pressure at the purer water outlet of the second separator section; and $P_3$ is defined as the pressure at the less pure outlet of the second separator section.

6. A downhole well pump assembly according to claim 1, further comprising:

a third pump section connected to the oil outlet of the first separator section for assisting in pumping the oil to the surface, wherein said third pump section is located above said first and second pump sections and pumps upward;

said first pump section and said second pump section pump downward to said separators; and a single motor operates said first pump section, said second pump section, and said third pump section.

7. An assembly for use in a well containing a mixture of hydrocarbons and water wherein said assembly separates said hydrocarbons from said mixture, injects the heavier fluids into the well, and pumps the lighter fluids to the surface, said assembly comprising;

a third pump section attached to a lower end of a production tubing inside of well casing;

a motor operatively connected to said third pump section;

a first pump section operatively connected to said motor, said first pump section having a well fluid intake for receiving well fluid;

a second pump section affixed to a lower end of said first pump section, said second pump section receiving fluid from an inter-tandem intake between said first pump section and said second pump section;

a first downhole separator section affixed to a lower end of said second pump section, said first downhole separator section being in communication with said third pump section by an oil bypass tube for transferring oil separated by the first downhole separating section to said third pump section for pumping the oil up the production tubing;

a second downhole separator section affixed to a lower end of said first downhole separator section, said second downhole separator section having a purer water outlet discharging into a desired location and a less pure outlet connected to said inter-tandem intake downstream of the first pump section for passing the less pure water back through the first and second separator sections; and said less pure outlet of said second downhole separator section being in communication with said inter-tandem intake by a recycle tube.

8. A downhole well pump assembly according to claim 7 wherein the ratio $(P_1-P_3)/(P_1-P_2)$ is between approximately 1.7 and 4.0, wherein $P_1$ is defined as the pressure at the inlet to the second separator section;

$P_2$ is defined as the pressure at the purer water outlet of the second separator section; and $P_3$ is defined as the pressure at the less pure outlet of the second separator section.

9. A method of injecting water and producing oil in a well comprising the steps of:

receiving a mixture of oil and water from a production zone in a production fluid intake of a first pump section;

providing a second pump section having an outlet and an intake that is connected to the outlet of the first pump section, and discharging all of the oil and water from said first pump section into said second pump section;

discharging the oil and water from the second pump section into an inlet of a first separator section and separating the oil and water in the first separator section;

discharging oil to the surface from an oil outlet of said first separator section;

discharging a mixture of oil and water from said first separator section into a second separator section and further separating oil from the water with said second separator section;

discharging purer water into a desired location from a purer water outlet in said second separator section; and passing less pure water separated by said second separator section back through the first and second separator sections by discharging less pure water from a less pure water outlet in said second separator section to the intake of the second pump section downstream of the first pump section.

10. The method according to claim 9 wherein said one of said pump sections receiving said discharge of said less pure water is said second pump section.

11. The method according to claim 9, further comprising:

connecting a third pump section to the oil outlet of the first separator section for assisting in pumping the oil to the surface.

12. The method according to claim 9, further comprising:

connecting a third pump section to the oil outlet of the first separator section for assisting in pumping the oil to the surface;

pumping oil upwards to the surface from said third pump section;

pumping said oil and water from said production zone downwards from said first pump section and said second pump section to said separator sections; and operating said first pump section, said second pump section, and said third pump section with a single motor.

* * * * *